US009651224B1

(12) United States Patent
Burgess et al.

(10) Patent No.: US 9,651,224 B1
(45) Date of Patent: May 16, 2017

(54) WORK LIGHT WITH VARIABLE VOLTAGE TRANSFORMER AND REMOVABLE LENS

(71) Applicants: Paul Burgess, Lodi, NJ (US); Stephanie Burgess, Lodi, NJ (US)

(72) Inventors: Paul Burgess, Lodi, NJ (US); Stephanie Burgess, Lodi, NJ (US)

( * ) Notice: Subject to any disclaimer, the term of this patent is extended or adjusted under 35 U.S.C. 154(b) by 162 days.

(21) Appl. No.: 14/580,402

(22) Filed: Dec. 23, 2014

Related U.S. Application Data

(60) Provisional application No. 61/928,626, filed on Jan. 17, 2014.

(51) Int. Cl.

| | |
|---|---|
| ***F21V 23/02*** | (2006.01) |
| ***F21V 31/00*** | (2006.01) |
| ***F21L 14/02*** | (2006.01) |
| ***F21V 17/16*** | (2006.01) |
| ***F21L 4/08*** | (2006.01) |
| ***F21V 5/04*** | (2006.01) |
| *F21Y 101/02* | (2006.01) |

(52) U.S. Cl.
CPC ..... *F21V 17/16* (2013.01); *F21L 4/08* (2013.01); *F21V 5/04* (2013.01); *F21V 31/005* (2013.01); *F21Y 2101/02* (2013.01)

(58) Field of Classification Search
CPC . F21L 15/04; F21L 15/06; F21L 14/02; F21V 15/01; F21V 17/002; F21V 17/168; F21V 23/02; F21V 23/023; F21V 31/005; F21W 2131/403
See application file for complete search history.

(56) References Cited

U.S. PATENT DOCUMENTS

| | | | | |
|---|---|---|---|---|
| 4,539,629 A * | 9/1985 | Poppenheimer | F21S 8/00 | 362/267 |
| 4,751,621 A * | 6/1988 | Jenkins | B26B 11/008 | 362/119 |
| 5,041,950 A * | 8/1991 | Tyson | F21S 8/022 | 362/153.1 |
| 5,165,782 A * | 11/1992 | Maglica | F21V 15/00 | 362/202 |
| 5,436,815 A * | 7/1995 | Grooms | F21L 14/026 | 362/216 |
| 5,784,208 A * | 7/1998 | Kanno | G03B 11/045 | 359/704 |
| 5,873,647 A * | 2/1999 | Kurtz | B05B 15/00 | 362/101 |
| 6,619,818 B2 * | 9/2003 | Grove | B60Q 1/2657 | 362/267 |

(Continued)

FOREIGN PATENT DOCUMENTS

| | | |
|---|---|---|
| EP | 2497998 | 9/2012 |
| WO | WO2007004867 | 1/2007 |

(Continued)

*Primary Examiner* — Ismael Negron
(74) *Attorney, Agent, or Firm* — Werschulz Patent Law, LLC

(57) ABSTRACT

A work light includes a beveled elastomeric gasket coupling a selectively removable lens to a housing containing a light source and a variable voltage transformer for connecting the light source to a power supply. The elastomeric gasket fits snugly to the work light housing and the lens, creating a waterproof and dust-proof seal around the housing and lens. The housing is provided with cooling fins to help dissipate heat generated by the work light.

6 Claims, 6 Drawing Sheets

(56) References Cited

U.S. PATENT DOCUMENTS

| | | | | |
|---|---|---|---|---|
| 7,004,600 | B2 * | 2/2006 | Echterling | F21V 5/006 362/187 |
| 7,255,460 | B2 * | 8/2007 | Lee | F21V 9/08 362/231 |
| 7,866,850 | B2 * | 1/2011 | Alexander | F21V 19/001 362/147 |
| 8,033,677 | B1 * | 10/2011 | Olsson | F21V 7/0083 114/312 |
| 8,256,919 | B2 | 9/2012 | Holder | |
| 2009/0303699 | A1 | 12/2009 | Van Gestel | |
| 2010/0176706 | A1 | 7/2010 | Fu | |
| 2012/0230033 | A1 | 9/2012 | Yoon | |
| 2014/0211474 | A1 * | 7/2014 | Juan | F21V 15/01 362/267 |

FOREIGN PATENT DOCUMENTS

| | | |
|---|---|---|
| WO | WO2012097721 | 7/2012 |
| WO | WO2012156859 | 11/2012 |

* cited by examiner

WORK LIGHT WITH VARIABLE VOLTAGE TRANSFORMER AND REMOVABLE LENS

CROSS-REFERENCE TO RELATED APPLICATIONS

This application is a nonprovisional utility application of the provisional patent application, Ser. No. 61/928,646 filed in the United States Patent Office on Jan. 17, 2014 and claims the priority thereof and is expressly incorporated herein by reference in its entirety

TECHNICAL FIELD

The present disclosure relates generally to a work light and its lens system. More particularly, the present disclosure relates to an ultra bright sand blasting work light and a quick-change lens system for said work light.

BACKGROUND

Sand blasting is used in maintenance of bridges and other structures. Sand blasting removes layers of rust and paint prior to repainting the surface so that new paint can bind properly.

Sand blasting uses high pressure and abrasive material forced through a nozzle on a blast hose at the area being blasted. When sand blasting, a cloud of dust is created by the blast media and particulates that obscures the work area. The sand blaster has a light attached to the blast hose adjacent to the nozzle to see the work area through the cloud of blast material.

Current lights burn out frequently and need to be replaced. Additionally, the lens that protects the light bulb from the blast media and debris is damaged in the process and needs to be frequently replaced. The protective lens attaches by a metal gasket with spring clips, screws or similar fasteners and is neither waterproof nor dust-proof offering little protection to the light itself.

The light requires disassembly to change the bulb, which involves the worker leaving the immediate area, finding tools such as a screwdriver, replacing the bulb and then returning to the work area. Since the work area may be on a scaffold high above, time is lost while the worker descends, traverses the site in search of a new light bulb and re-ascends to the work area. This may happen once a shift for each worker, causing great loss of productivity and slippage of timetables.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a sand blasting light having a quick-change lens for rapid changing of a light bulb and a lens, increasing productivity. Accordingly, the present disclosure provides a sandblasting light that has a beveled rubber gasket that couples a lens of a sand blasting light to a housing, the lens selectively removable without tools so that the lens is easily replaced.

A further aspect of an example embodiment in the present disclosure is to provide a sand blasting light having a waterproof, dust-proof housing without grit building up around the lens and light reflector. Accordingly, the present disclosure provides a sand blasting light that has a beveled elastic gasket that fits snugly to the light housing and the lens, creating a waterproof and dust-proof seal at the junction of the light housing and lens.

Another aspect of an example embodiment in the present disclosure is to provide a sand blasting light that can be used with a plurality of blast hoses sizes. Accordingly, the present disclosure provides a sand blasting light with a selectively replaceable bracket, the bracket replaceable with a bracket of a different size so that the sand blasting light is not limited to a particular blast hose.

A still further aspect of an example embodiment in the present disclosure is to provide a sand blasting light that uses a variable amount of power so that the light can selectively be connected to a plurality of blast units having a different voltages. Accordingly, the present disclosure provides a sand blasting light with an internal variable voltage capability, the light having a potentiometer that allows a voltage to be selected so that the sand blasting light is not limited to a blast unit with a particular voltage, further eliminating the necessity of an external transformer.

Yet another aspect of an example embodiment in the present disclosure is to provide a sand blasting light that does not overheat when used continuously. Accordingly, the present disclosure provides a sand blasting light having a housing with cooling fins that keep the light-emitting diode (LED) light cool, the LED light producing less heat and lasting longer than the traditional halogen lights used in the prior art.

Accordingly, the present disclosure describes a sand blasting work light that has a beveled rubber gasket that couples a lens to a housing that is selectively removable without tools so that the lens is easily replaced. The beveled elastic gasket fits snugly to the light housing and the lens, creating a waterproof and dust-proof seal around the housing and lens. The light has a selectively replaceable bracket, replaceable by different sizes to adapt to different blast hoses. The light has variable voltage capability that allows a voltage to be selected, eliminating a transformer used to connect to different voltage blast units. The sand blasting light does not overheat when used continuously having a housing with cooling fins and a low-heat producing, long-lasting LED (light-emitting diode) light.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1A:
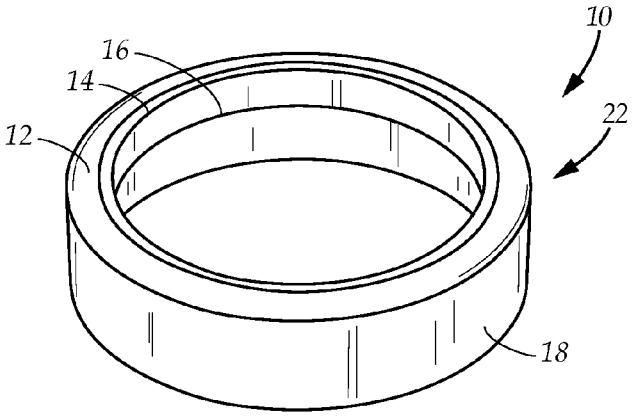
FIG. 1A is a top perspective view of an example embodiment of a gasket of a quick-change lens system.
Figure 1B:
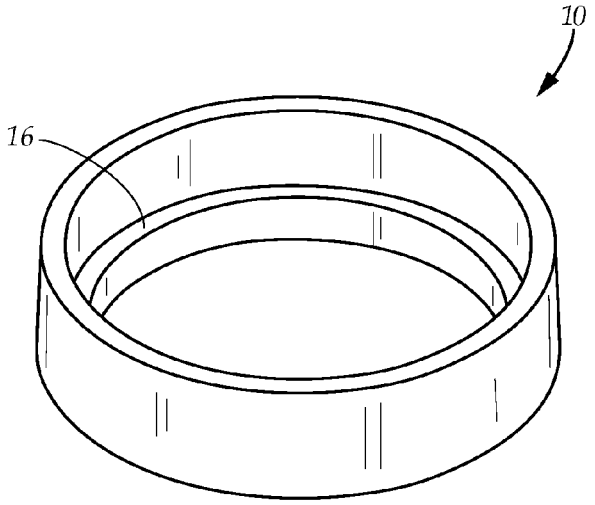
FIG. 1B is a bottom perspective view of an example embodiment of a gasket of a quick-change lens system.
Figure 1C:
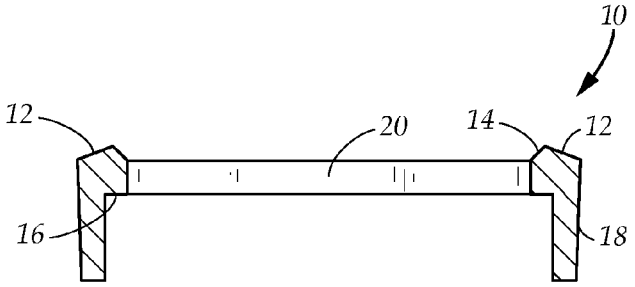
FIG. 1C is a cross-section view of an example embodiment of the gasket of a quick-change lens system from the side.

FIGS. 1A through 1C illustrates an example embodiment of a quick-change gasket 10 operative for attaching a protective lens 20 to a sand blasting work light. The gasket 10 provides a method of changing the lens on site during sand blasting work. Lenses must be changed frequently, about once a shift because the lenses become opaque as a result of sand blasting media striking the surface. Work lights in the prior art use halogen bulbs that have a short life and must be frequently replaced. To replace the bulb, the lens must be removed. In the prior art, the lens of the work light was held in place by metal rings or metal snap rings fastened with screws, bolts or spring clips that was neither waterproof or dust-proof. To change a lens meant finding tools to remove the metal rings, which created a time-consuming disruption on the job.

An example embodiment of the gasket 10 shown in FIGS. 1A through 1C is configured for coupling the lens to a work light housing quickly without tools. The quick-change gasket 10 allows the lens to be replaced in less than a minute, greatly reducing the interruption to the job that occurs in prior systems.

The gasket 10 has a side wall 18 defining a cylindrical space, a beveled top portion 22 with an outside bevel 12 and an inside bevel 14, the outside bevel 12 sloping downwardly, away from the cylindrical space, the inside bevel 14 sloping downwardly, toward the cylindrical space.

On the side wall 18 below the top portion 22 is a decremental inside lip 16 defining a decremental inner diameter. The decremental inside lip 16 and beveled top portion 22 is configured for engaging the lens 20 when coupling to a work light housing.

The gasket 10 elastically engages the lens 20 with a compression force and without fasteners. The outer surface of the lens 20 is flush with the inside bevel 14 of the gasket 10. The gasket 10 is made from an elastomeric material selected from the group consisting of natural rubber, synthetic rubber and silicone rubber. The seal formed by the gasket 10 is watertight and dust-tight.

Figure 2:
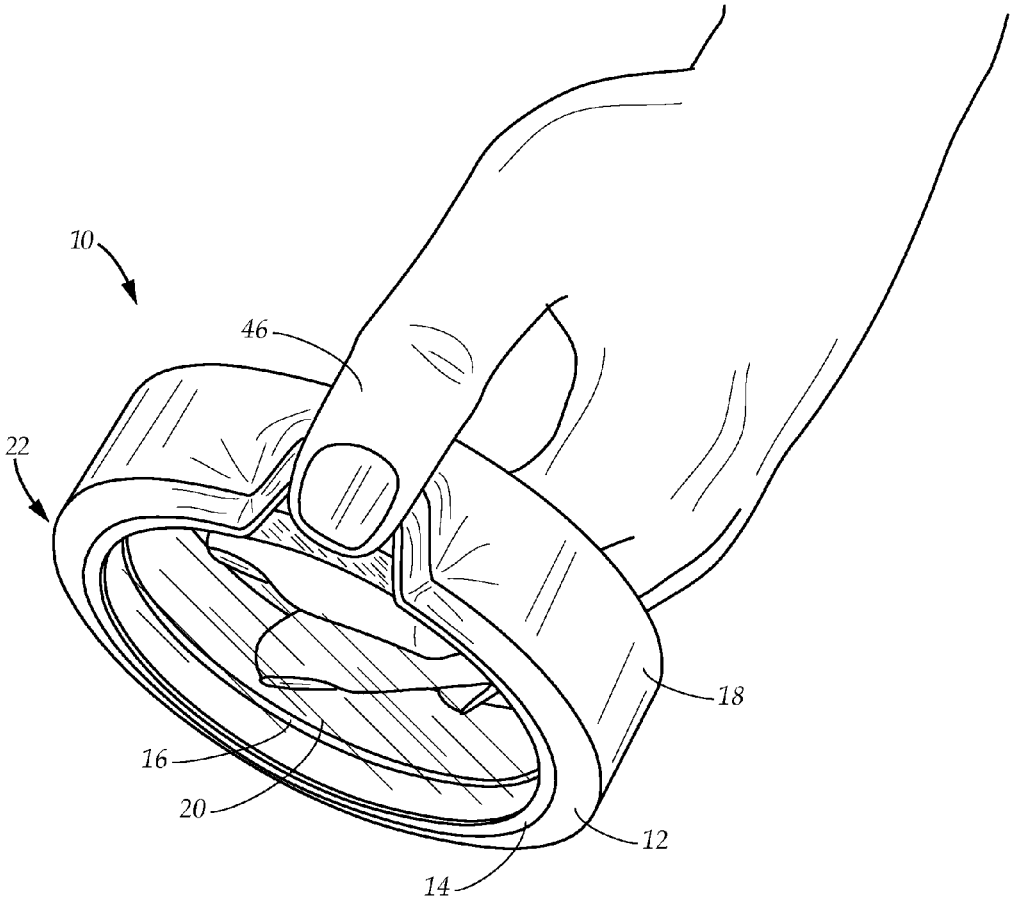
FIG. 2 is a perspective view of an example embodiment of the gasket being removed from a lens without tools.

FIG. 2 demonstrates the method of selectively removing the lens 20 from the gasket 10 by rolling the gasket 10 back by a thumb 46 engaging the top portion 22 the inside bevel 14 and rolling the inside bevel 14 away from the lens 20 toward the outside bevel 12 thereby releasing the compression force that engages lens 20 without tools. A replacement lens 20 pops into the gasket 10 and is held snugly by compression providing the waterproof, dust-proof seal.

Figure 3A:
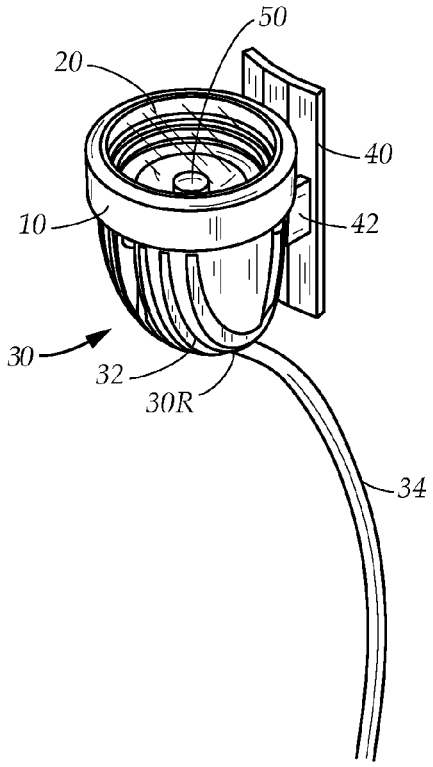
FIG. 3A is a perspective view of an example embodiment of a work light with a mounting bracket and the quick-change lens system.
Figure 3B:
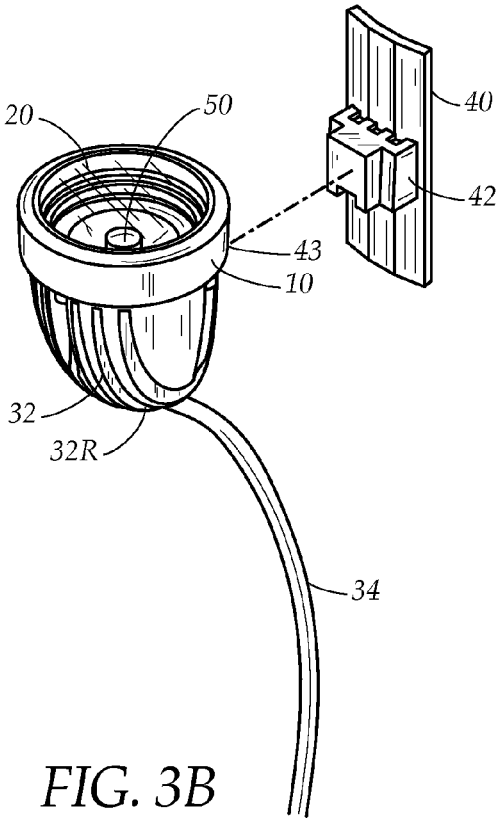
FIG. 3B is a perspective view of an example embodiment of the work light with the mounting bracket separating from the work light housing.

FIGS. 3A and 3B shows an example embodiment of a work light having a housing 30, a selectively replaceable bracket 40 and the gasket 10 as described hereinabove engaging the housing 30 and the protective lens 20 covering a light-emitting diode (LED) light bulb 50.

The LED light bulb 50 has a high Color Rendering Index (CRI) of 93 approaching incandescent bulbs, produces 1200 lumens of light using 12 watts of power with natural-looking colors. The LED light bulb 50 has neodymium in the glass of the bulb, tinting the glass blue/violet, creating a spectral notch that produces the high CRI. The LED light bulb is long lasting estimated to have a 50,000-hour life expectancy, requiring infrequent replacement, producing brighter light and lower heat. The LED light bulb accommodates variable voltages so that the work light of the present system accommodates power supplies from various manufacturers.

In one example embodiment, the work light connects by a wire 34 to a power supply. In a further example embodiment, the power supply is a rechargeable battery within the housing 30.

Figure 4:
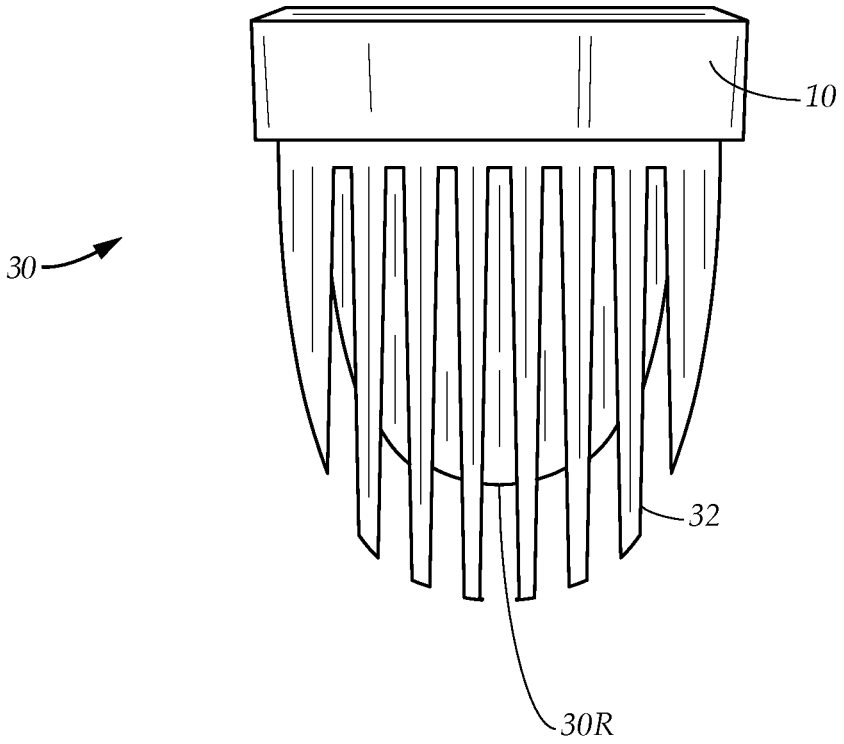
FIG. 4 is a top plan view of an example embodiment of a sandblasting work light housing.

In one example embodiment shown in FIGS. 3A, 3B and 4, the housing has a rear portion 30R having a plurality of heat-dissipating fins 32 behind the gasket 10 and lens 20, directionally opposite the gasket 10 and lens 20 and the light 50 behind the lens 20. The fins 32 are configured to cool the work light when used continuously, dissipating any heat caused by the light bulb 50.

In a further example embodiment, the housing 30 has a selectively replaceable bracket 40 at the bottom configured for attaching to a blast hose. The replaceable brackets 40 are configured in different sizes operative for coupling to different size blast hoses. The bracket 40 of the work light is coupled to a blast hose with hose clamps or other means know to those of ordinary skill, such that the curvature of the bracket 40 must conform to the curvature of the hose which varies based on the hose diameter. Using selectively replaceable brackets configured to couple to a different blast hose sizes allows the work light to couple to blast hoses that vary in size, which typically runs from one-half inch to one and one-half inches in diameter.

In another example embodiment, the housing 30 has a socket 43 for selectively attaching the bracket 40, the bracket 40 having a plug 42 mating to the socket 43, each bracket configured to couple to the sand blasting hose.

Figure 5:
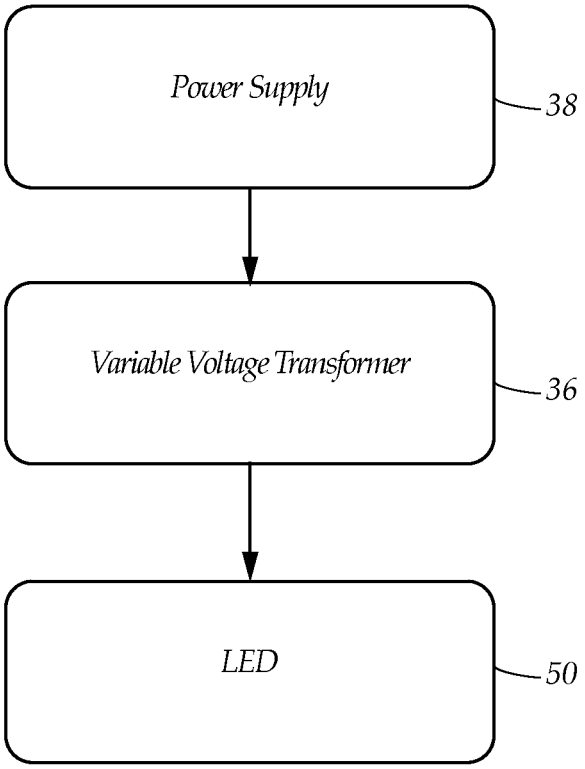
FIG. 5 is a block diagram of an example embodiment of work light power system.

As illustrated in the block diagram in FIG. 5, inside the housing is a variable voltage transformer 36, such as a potentiometer connecting to a power supply 38. The variable voltage transformer 36 provides variable voltage capability to the sand blasting work light that allows a voltage to be selected ranging from 12 to 60 volts, eliminating the need for an external transformer used to connect to different blast units, each manufacturer using a different voltage battery or power supply. The variable voltage transformer powers the light bulb 50, which is one example embodiment is an LED bulb.

Figure 6:
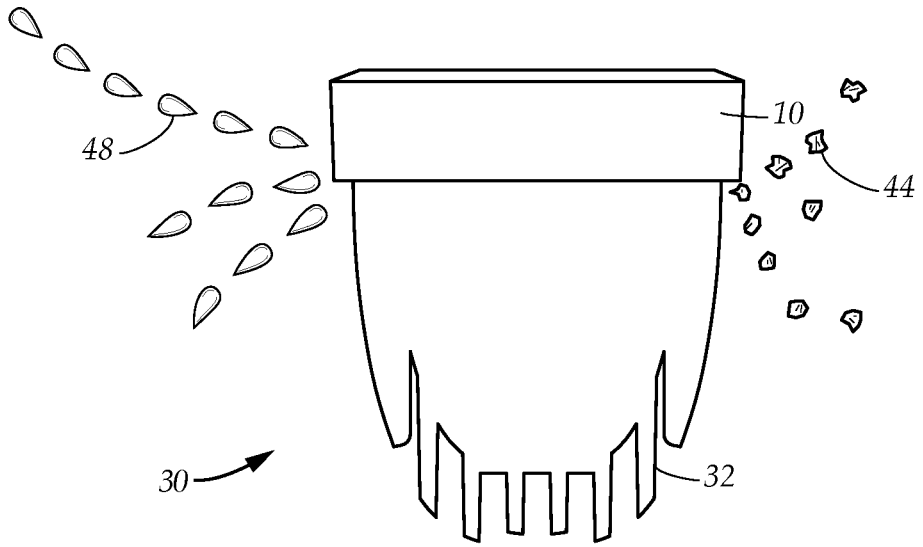
FIG. 6 is a top plan view of an example embodiment of the sand blasting work light housing and quick-change lens system.

FIGS. 2 and 6 illustrate a method for installing the lens 20 on the work light. The method comprises placing the gasket 10 on a work light housing 30, the work light housing have an open end with a light bulb therein, the gasket 10 fitting over said open end, the gasket having the lip 16 engaging the open end of the housing 30.

The gasket 10 expands by rolling the inside bevel 14 toward the outside bevel 12 with the thumb 46, inserting the lens 20 into the gasket 10 and releasing the gasket 10. The gasket 10 grasps the lens 20, holding the lens 20 with compression force, forming a watertight, dust-tight seal over the open end of the work light housing.

In another example embodiment, the step of placing the gasket 10 on the work light housing 30 follows the step of inserting the lens 20 into the gasket 10 and releasing the gasket 10, the gasket 10 grasping the lens 20 forming a watertight, dust-tight seal over the open end of the work light.

FIG. 6 illustrates how the housing 30 with the fins 32 opposing the gasket resists water drops 48 and blast media 44 generated during the sand blasting process.

The work light of the present disclosure is advantageously brighter, lighter and smaller than the lights in the prior art, thus highly adapted for tight spaces. Further, the work light of the present disclosure having the variable voltage capability and interchangeable hose brackets is useful with virtually every blast unit in the prior art. The work light of the present disclosure presents a significant cost savings in terms of efficiencies and productivity.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an ultra bright sand blasting work light and a quick-change lens system for said work light. The disclosure is illustrated by example in the drawing figures, and throughout the written description. It should be understood that numerous variations are possible, while adhering to the inventive concept. Such variations are contemplated as being a part of the present disclosure.

What is claimed is:

1. A work light having, comprising:

a housing;

a variable voltage transformer disposed within the housing, and configured for connecting to a power supply;

a light-emitting diode (LED) light bulb powered through the transformer;

an elastomeric gasket; and a protective lens covering the light bulb, and coupled to the housing by the elastomeric gasket, wherein the elastomeric gasket has a side wall defining a cylindrical space, a beveled top portion having an outside bevel and an inside bevel, the outside bevel sloping downwardly away from the cylindrical space, the inside bevel sloping downwardly toward the cylindrical space, and a decremental inside lip on the side wall below the top portion.

2. The work light as described in claim 1, further comprising a plurality of heat-dissipating fins disposed on a rear portion of the housing.

3. The work light as described in claim 2, the housing further including a replaceable bracket.

4. The work light as described in claim 3, further including:

a plug included in the removable bracket; and a socket for removably mating with the plug for coupling the bracket to the housing.

5. The work light as described in claim 4, wherein the bracket is selected from a plurality of selectively removable brackets, each bracket configured to couple to a different blast hose size, and the socket is configured to accept at least one of the plurality of selectively removable brackets.

6. The work light as described in claim 5, further comprising, is a rechargeable battery within the housing, the rechargeable battery being the power supply.

* * * * *